US007069740B2

(12) United States Patent
Lee et al.

(10) Patent No.: US 7,069,740 B2
(45) Date of Patent: Jul. 4, 2006

(54) ACCUMULATOR AND AIR CONDITIONING SYSTEM USING THE SAME

(75) Inventors: Won Hee Lee, Seoul (KR); Yoon Jei Hwang, Seoul (KR); Chan Ho Song, Gwacheon-si (KR)

(73) Assignee: LG Electronics Inc, Seoul (KR)

( * ) Notice: Subject to any disclaimer, the term of this patent is extended or adjusted under 35 U.S.C. 154(b) by 10 days.

(21) Appl. No.: 10/716,558

(22) Filed: Nov. 20, 2003

(65) Prior Publication Data

US 2004/0099008 A1 May 27, 2004

(30) Foreign Application Priority Data

Nov. 23, 2002 (KR) ..... 10-2002-0073286

(51) Int. Cl.

| | |
|---|---|
| ***F25B 43/00*** | (2006.01) |
| ***F25B 1/00*** | (2006.01) |
| ***B01D 41/00*** | (2006.01) |
| ***B01D 19/00*** | (2006.01) |

(52) U.S. Cl. ..... 62/503; 62/512; 62/498; 96/188; 96/189; 96/197; 96/220; 55/424; 55/426

(58) Field of Classification Search ..... 62/503, 62/498, 512; 96/188, 189, 197, 220; 55/424, 55/426

See application file for complete search history.

(56) References Cited

U.S. PATENT DOCUMENTS

| | | | | | |
|---|---|---|---|---|---|
| 5,396,776 | A * | 3/1995 | Kim | ..... | 62/115 |
| 5,404,730 | A * | 4/1995 | Westermeyer | ..... | 62/470 |
| 5,551,255 | A * | 9/1996 | Rothfleisch | ..... | 62/502 |
| 5,605,058 | A * | 2/1997 | Kurachi et al. | ..... | 62/503 |
| 5,966,952 | A * | 10/1999 | Misawa et al. | ..... | 62/159 |
| 6,449,980 | B1 * | 9/2002 | Minister | ..... | 62/513 |
| 6,519,971 | B1 * | 2/2003 | Kim | ..... | 62/503 |

FOREIGN PATENT DOCUMENTS

| | | | | | |
|---|---|---|---|---|---|
| JP | 57-044375 | | 3/1982 | | |
| JP | 02-154957 | * | 6/1990 | ..... | 62/503 |

OTHER PUBLICATIONS

English Language Abstract of JP57-044375.

* cited by examiner

*Primary Examiner*—Cheryl Tyler
*Assistant Examiner*—Filip Zec
(74) *Attorney, Agent, or Firm*—Greenblum & Bernstein, P.L.C.

(57) ABSTRACT

An improved accumulator is disclosed, which includes a body having an empty space therein; an inlet tube inserted into the inside of the body from a top thereof, downwardly, for an inflow of a refrigerant to the inside of the body; an outlet tube inserted into the inside of the body from a bottom thereof, upwardly, for a discharge of the refrigerant to the outside of the body; and an isolating plate provided on an inner bottom of the body between the inlet tube and the outlet tube, for preventing the outlet tube from being splashed with the liquid phase refrigerant, and preventing the liquid phase refrigerant from flowing into the outlet tube.

21 Claims, 6 Drawing Sheets

ACCUMULATOR AND AIR CONDITIONING SYSTEM USING THE SAME

This application claims the benefit of the Korean Application No. P2002-0073286 filed on Nov. 23, 2002, which is hereby incorporated by reference.

BACKGROUND OF THE INVENTION

1. Field of the Invention

The present invention relates to an air conditioning system, and more particularly, to an improved accumulator and an air conditioning system using the same.

2. Discussion of the Related Art

Generally, an air conditioning system is a system to heat an indoor room by use of a phenomenon of radiating heat into the surroundings when a refrigerant is condensed, and to cool an indoor room by use of a phenomenon of absorbing heat into the surroundings when a refrigerant is vaporized.

FIG. 1 illustrates one example of an air conditioning system simultaneously performing cooling and heating operations. Referring to FIG. 1, the air conditioning system is provided with an outdoor unit 10 and an indoor unit 20, largely. At this time, the outdoor unit 10 is provided with a compressor 11, a flowing control valve 12, a first expansion device 15, an outdoor heat exchanger 13 and an accumulator 14. Also, the indoor unit 20 is provided with an indoor heat exchanger 22 and a second expansion device 21. Herein, the outdoor and indoor heat exchangers 13 and 22 are respectively adjacent to an outdoor fan 13*a* and an indoor fan 22*a*.

Hereinafter, a connection structure of the aforementioned components by tubes will be described in detail.

First, a first tube 33 connects an outlet 11*a* of the compressor 11 to a first port 12*a* of the flowing control valve 12, and a second tube 34 connects a third port 12*c* of the flowing control valve 12 to an inlet of the accumulator 14. Also, a third tube 35 connects an outlet of the accumulator 14 to an inlet 11*b* of the compressor 11, and a fourth tube 36 connects a second port 12*b* of the flowing control valve 12 to one end of the outdoor heat exchanger 13. Then, a fifth tube 31 connects the other end of the outdoor heat exchanger 13 to one end of the indoor heat exchanger 22. At this time, the respective first and second expansion devices 15 and 21 are provided in the fifth tube 31 for being positioned inside the indoor unit 10 and the outdoor unit 20. Meanwhile, a sixth tube 32 connects the other end of the indoor heat exchanger 22 to a fourth port 12*d* of the flowing control valve 12.

In the aforementioned air conditioning system shown in FIG. 2, the accumulator 14 is formed in a container shape having an empty space therein, such as a cylinder. At this time, the inlet of the accumulator 14 is connected to the second tube 34 for providing a refrigerant, and the outlet of the accumulator 14 is connected to the third tube 35 for discharging the refrigerant. At this time, as shown in FIG. 2, the second tube 34 is inserted to the inside of the accumulator 14 from a top of the accumulator 14, through which the refrigerant flows into the accumulator 14. That is, one end of the second tube 34 is positioned at an inner lower portion of the accumulator 14. Also, the third tube 35 for discharging the refrigerant is inserted into the inside of the accumulator 14 from a bottom of the accumulator 14. That is, one end of the third tube 35 is positioned at an inner upper portion of the accumulator 14.

Hereinafter, an operation of the air conditioning system will be described in brief. For reference, a solid arrow indicates a refrigerant flow when cooling the indoor room, and a dotted arrow indicates a refrigerant flow when heating the indoor room.

First, on a cooling operation mode of the air conditioning system, the refrigerant discharged from the outlet 11*a* of the compressor 11 flows into the outdoor heat exchanger 13 by a guide of the flowing control valve 12. The refrigerant condensed in the outdoor heat exchanger 13 passes through the first expansion device 14, which is completely open, and then expanded in the second expansion device 21. Subsequently, the refrigerant absorbs the surrounding heat in the indoor heat exchanger 22 when the refrigerant expanded in the second expansion device 21 is vaporized in the indoor heat exchanger 22. At this time, the indoor room is ventilated with a cold air surrounding the indoor heat exchanger 22 by the indoor fan 22*a*, whereby the indoor room is cooled. After cooling the indoor room, the refrigerant flows into the accumulator 14 by a guide of the flowing control valve 12. At this time, the refrigerant flows into the accumulator 14 at a high pressure. That is, the refrigerant is sprayed to the inner space of the accumulator 14 from the end of the second tube 34. Thus, the gas phase refrigerant flowing to the accumulator 14 is discharged through the third tube 35, and then flows into the inlet 11*b* of the compressor 11.

On a heating operation mode of the air conditioning system, the refrigerant discharged from the compressor 11 flows into the indoor heat exchanger 22 by a guide of the flowing control valve 12. Then, when the refrigerant is condensed in the indoor heat exchanger 22, the refrigerant radiates condensing heat to the surroundings. At this time, the indoor fan 22*a* discharges the heat radiated from the indoor heat exchanger 22 to the indoor room, so that the indoor room is heated. After that, the refrigerant condensed in the indoor heat exchanger 22 passes through the second expansion device 21, which is completely open, and then expanded in the first expansion device 15. Herein, the refrigerant expanded in the first expansion device 15 passes through the outdoor heat exchanger 13, the flowing control valve 12 and the accumulator 14, sequentially, and then flows into the inlet 11*b* of the compressor 11.

However, the related art air conditioning system for cooling or heating the indoor room has the following disadvantages.

In the related art air conditioning system, the refrigerant is sprayed into the inner space of the accumulator 14 from the one end of the second tube 34 at an atmospheric pressure of 5 to 7. At this time, the refrigerant has two phases of liquid and gas states. Accordingly, when spraying the refrigerant into the inner space of the accumulator 14, the third tube 35 may be splashed with the liquid phase refrigerant from the inner bottom of the accumulator 14, whereby the liquid phase refrigerant may flow into the compressor 11. In case the liquid phase refrigerant flows into the compressor 11, it causes lowering of compression efficiency in the compressor 11, thereby lowering air conditioning efficiency. Also, the compressor 11 makes a noise, and has an operation problem.

If the air conditioning system is continuously operated for heating the indoor room in the winter season at an outdoor temperature of 5° C. or less, the surface of the outdoor heat exchanger 13 is covered with a frost, thereby lowering heat exchange efficiency of the outdoor heat exchanger 13 and the air conditioning efficiency. According to the frost on the surface of the outdoor heat exchanger 13, the temperature of the refrigerant flowing into the accumulator 14 becomes low, whereby the temperature of the refrigerant flowing into the compressor 11 becomes low. Thus, power consumption for compressing the refrigerant in the compressor 11 increases.

Also, the temperature of the refrigerant flowing to the air conditioning system becomes low, whereby it accelerates a phenomenon of generating the frost on the surface of the outdoor heat exchanger 13, thereby lowering the air conditioning efficiency.

SUMMARY OF THE INVENTION

Accordingly, the present invention is directed to an accumulator and an air conditioning system using the same that substantially obviates one or more problems due to limitations and disadvantages of the related art.

An object of the present invention is to provide an improved accumulator and an air conditioning system using the same, in which it is possible to prevent a liquid phase refrigerant from flowing into a compressor.

Another object of the present invention is to provide an improved accumulator and an air conditioning system using the same, for preventing a frost from being on a surface of an outdoor heat exchanger on a heating operation mode.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an accumulator includes a body having an empty space therein; an inlet tube inserted into the inside of the body from a top thereof, downwardly, for an inflow of a refrigerant to the inside of the body; an outlet tube inserted into the inside of the body from a bottom thereof, upwardly, for a discharge of the refrigerant to the outside of the body; and an isolating plate provided on an inner bottom of the body between the inlet tube and the outlet tube, for preventing the outlet tube from being splashed with the liquid phase refrigerant, and preventing the liquid phase refrigerant from flowing into the outlet tube.

At this time, each side of the isolating plate is in contact to an inner surface of the body, or is provided at a predetermined interval from an inner surface of the body. Also, the isolating plate divides an inner lower portion of the body into two blocks, or a plurality of blocks.

Meanwhile, the accumulator further includes at least one heater provided on the inner bottom of the body, for heating the refrigerant stored in the inside of the body. In this case, the heater is provided in the same block as that having the inlet tube. In case the isolating plate divides the inner lower portion of the body into the plurality of blocks, each block may have the individual heater. If necessary, the heater may be provided in some of the blocks.

In another aspect, an air conditioning system includes at least one compressor for compressing a refrigerant at a high pressure, and discharging the refrigerant; a flowing control valve connected to the compressor, for controlling a flowing direction of the refrigerant according to an operation mode; a plurality of heat exchangers, for being respectively positioned indoor and outdoor, and connected to the flowing control valve; at least one expansion device provided in a refrigerant tube directly connecting the heat exchangers; and an accumulator temporarily storing the refrigerant passing through the heat exchangers, and connected to an inlet of the compressor for providing the gas phase refrigerant to the compressor. At this time, the accumulator has the same structure as that mentioned above, so that the explanation of the accumulator will be omitted.

Meanwhile, in case the air conditioning system is provided with the plurality of compressors, the air conditioning system further includes a plurality of check valves, each provided between the outlet of each compressor and the flowing control valve, for preventing the refrigerant from flowing into the outlet of the compressor. At this time, each of the compressors may have different capacity.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, an improved accumulator and an air conditioning system using the same according to the present invention will be described with reference to the accompanying drawings.

Figure 3:
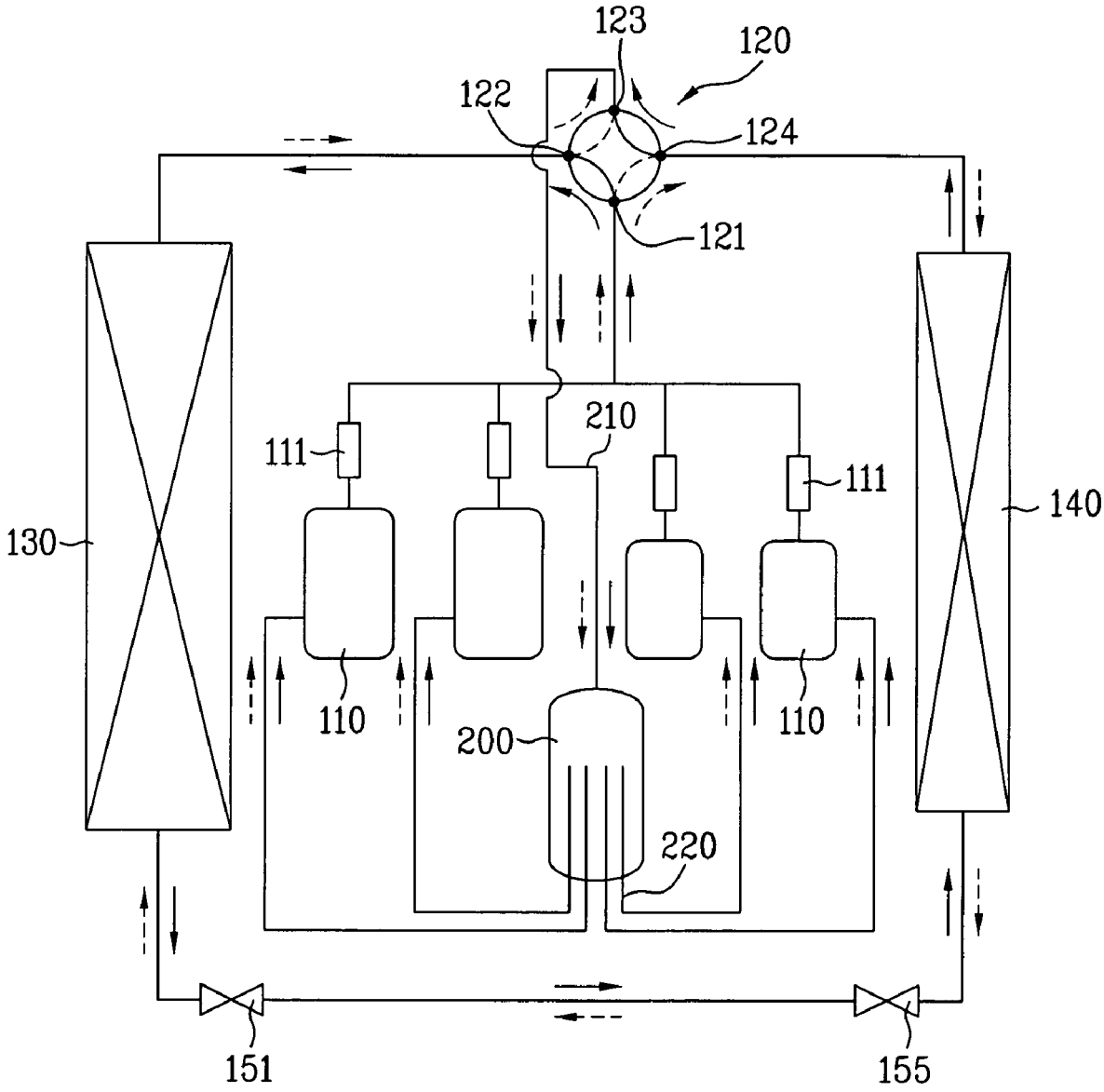
FIG. 3 is a schematic view illustrating one example of an air conditioning system having a plurality of compressors.

FIG. 3 is a schematic view illustrating one example of an air conditioning system having a plurality of compressors. Referring to FIG. 3, for example, four compressors 110 are provided, in which each compressor may have the same or different capacity, or some of them may have the same capacity, and the other may have the different capacity. In case of providing the plurality of compressors 110, it is possible to control the operation number of the compressors 110 according to load capacity required for cooling or heating an indoor room, thereby improving energy efficiency. Thus, it provides optimal air conditioning service according to the environment of the indoor room.

Figure 1:
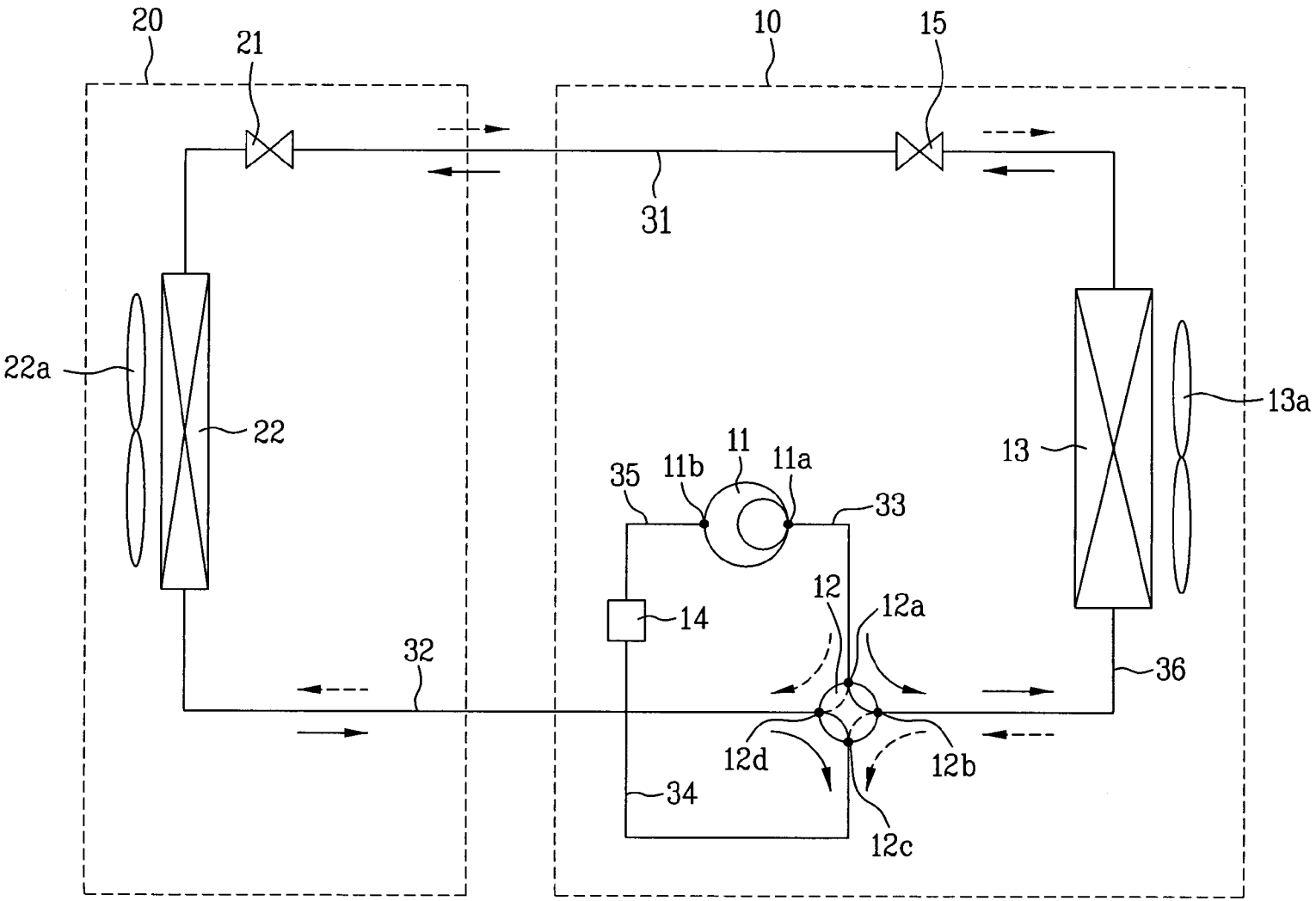
FIG. 1 is a schematic view illustrating one example of a related art air conditioning system performing cooling and heating operations.
Figure 2:
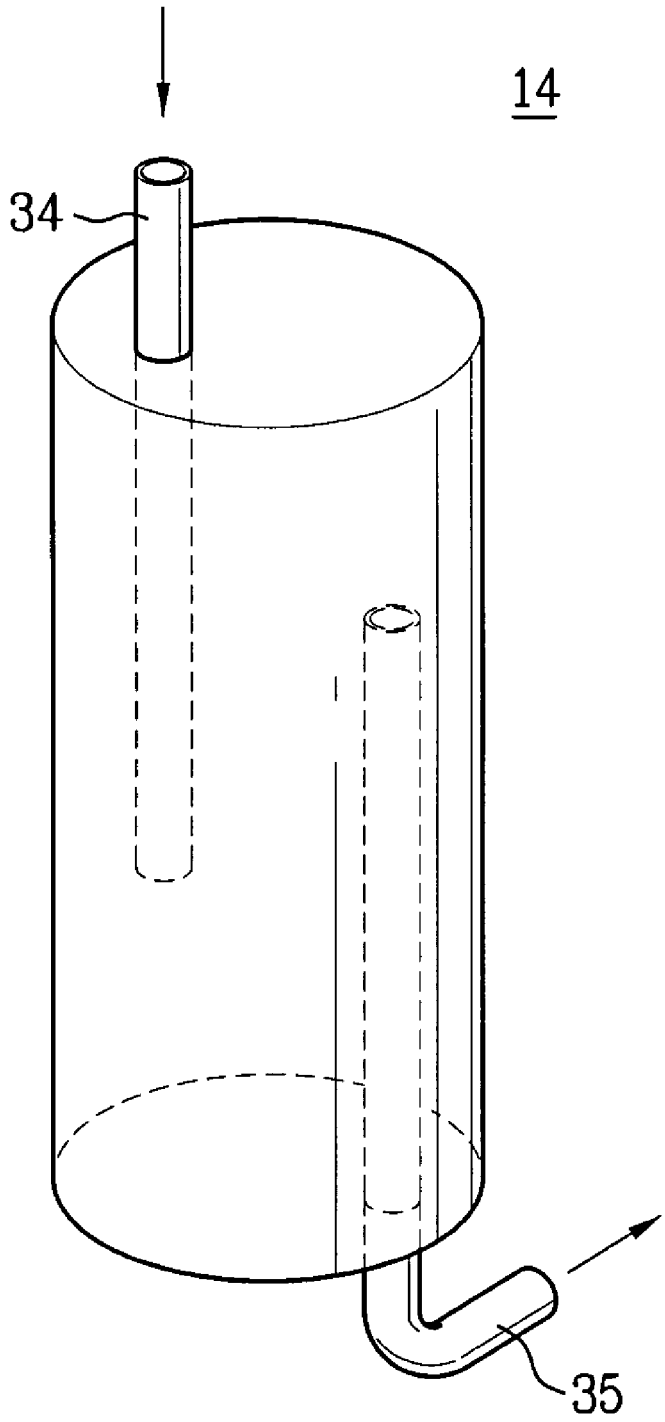
FIG. 2 is a perspective view illustrating an accumulator of FIG. 1.

When providing the plurality of compressors 110 in the air conditioning system, as shown in FIG. 3, a check valve 111 may be provided to each outlet of the compressors 110. The check valve 111 is provided between the outlet of the compressor 110 and a first port 121 of a flowing control valve 120, for passing a refrigerant discharged from the compressor 110, and blocking the flow of the refrigerant flowing toward the outlet of the compressor 110. Thus, the check valve 111 prevents the refrigerant from flowing into the outlet of the compressor 110 that is not operated, effectively. Also, in the air conditioning system according to the present invention, it is possible to provide one compressor instead of the plurality of compressors, as shown in FIG. 1. In this case, it is preferable to provide a variable compressor.

Referring to FIG. 3, the flowing control valve 120 is provided with four ports of the first port 121, a second port 122, a third port 123 and a fourth port 124. The first port 121 is connected to the inlet of each compressor 110, and the second port 122 is connected to one side of a first heat exchanger 130, as shown in FIG. 3. Also, the third port 123 is connected to an accumulator 200, and the fourth port 124 is connected to one side of a second heat exchanger 140.

At this time, the first heat exchanger 130 is provided outdoor, and the second heat exchanger 140 is provided indoor. As shown in FIG. 3, the first and second heat exchangers 130 and 140 are connected to each other through a refrigerant tube, the refrigerant tube having a plurality of expansion devices. In FIG. 3, two expansion devices, first and second expansion devices 151 and 155, are respectively provided for being in adjacent to the first and second heat exchangers 130 and 140. The first expansion device 151 passes the refrigerant flowing from the first heat exchanger 130 to the second heat exchanger 140, and expands the refrigerant flowing from the second heat exchanger 140 to the first heat exchanger 130. Also, the second expansion device 155 passes the refrigerant flowing from the second heat exchanger 140 to the first heat exchanger 130, and expands the refrigerant flowing from the first heat exchanger 130 to the second heat exchanger 140.

In case of the accumulator 200 shown in FIG. 3, an inlet tube 210 is connected to the third port 123 of the flowing control valve 120, and an outlet tube 220 is connected to the inlet of each compressor 110. The accumulator 200 temporarily stores the refrigerant passing through the first or second heat exchanger 130 or 140, discharges the gas phase refrigerant, and provides the gas phase refrigerant to the compressor 110.

Figure 4:
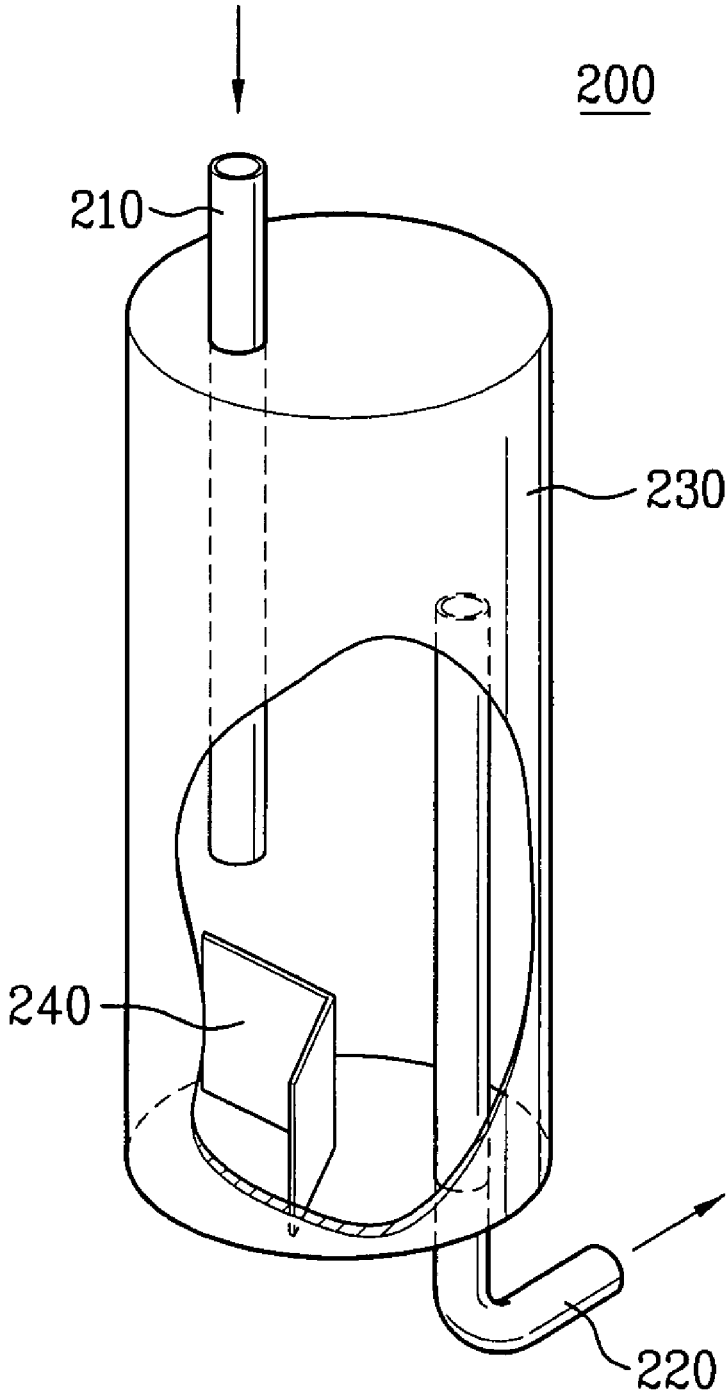
FIG. 4 is a partially cutaway perspective view illustrating an accumulator according to one preferred embodiment of the present invention.

Hereinafter, a structure of the accumulator 200 will be described with reference to FIG. 4. FIG. 4 is a partially cutaway perspective view illustrating an accumulator according to one preferred embodiment of the present invention. Referring to FIG. 4, the accumulator 200 is provided with a body 230, an inlet tube 210, an outlet tube 220 and an isolating plate. At this time, the body 230 is formed of a container shape having an empty space therein, such as a cylinder. Also, the inlet tube 210 is connected to the third port 123 of the flowing control valve 120, and the inlet tube 210 is inserted into the inner space of the body 230 from a top of the body 230, as shown FIG. 3 and FIG. 4. Preferably, an end of the inlet tube 210 is positioned at an inner lower portion of the body 230. Then, the outlet tube 220 is connected to the inlet of each compressor 110, and the outlet tube 220 is inserted into the inner space of the body 230 from a bottom of the body 230, as shown in FIG. 3 and FIG. 4. Preferably, an end of the outlet tube 220 is positioned at an inner upper portion of the body 230.

As shown in FIG. 4, the isolating plate 240 is positioned on an inner bottom of the body 230 between the inlet tube 210 and the outlet tube 220. When the refrigerant flows into the inside of the body 230 through the inlet tube 210, the outlet tube 220 is splashed with the liquid phase refrigerant from the inner bottom of the body 230, so that the liquid phase refrigerant may flow into the outlet tube 220. In this reason, the isolating plate 240 is provided for preventing the liquid phase refrigerant from flowing into the outlet tube 220. Preferably, the height of the isolating plate 240 is at 40% of the entire body height. However, in case a spraying pressure is high, it is possible to increase the height of the isolating plate 240.

Figure 6:
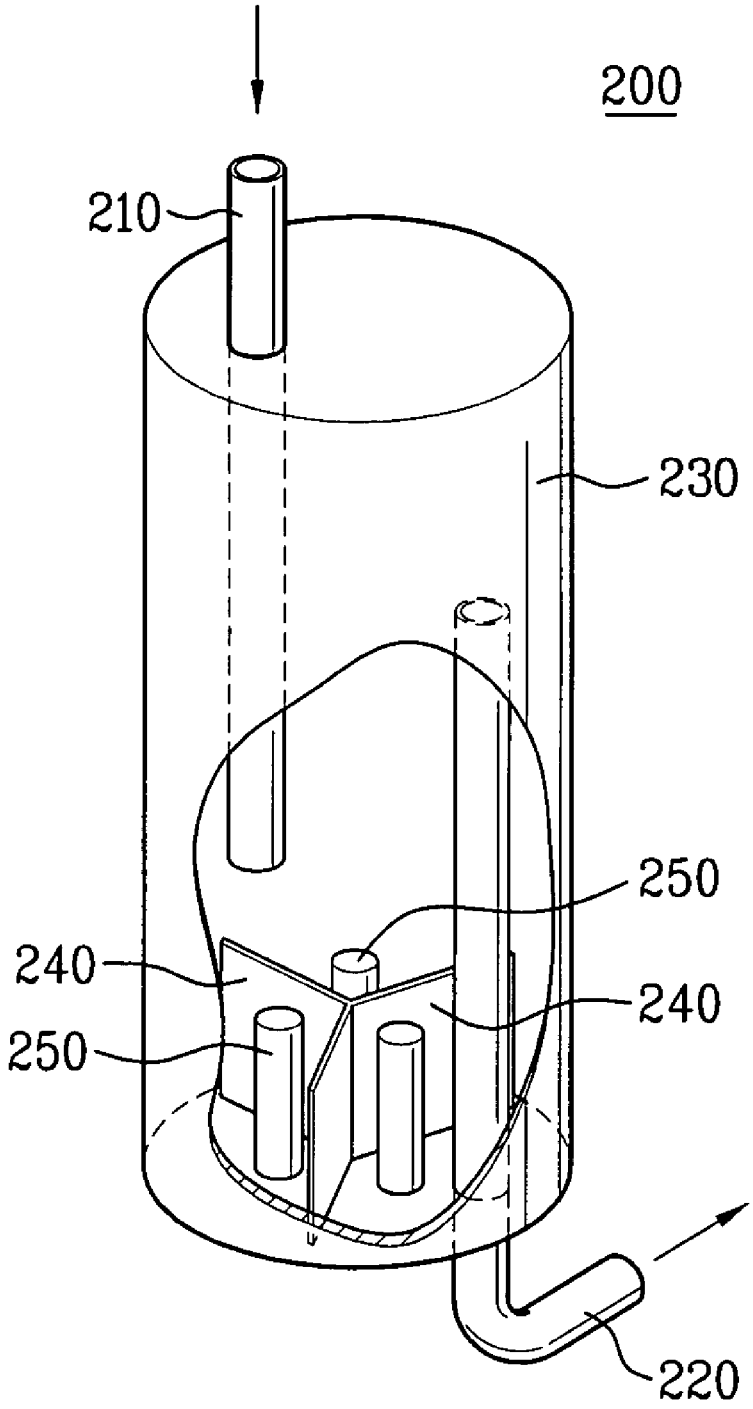
FIG. 6 is a partially cutaway perspective view illustrating an accumulator according to another preferred embodiment of the present invention.

As shown in FIG. 4, the isolating plate 240 divides the inner lower portion of the body 230 into two blocks. However, it is possible to divide the inner lower portion of the body 230 into the plurality of blocks with the isolating plate 240. For example, the inner lower portion of the body 230 is divided into the two blocks with the isolating plate 240, as shown in FIG. 4, or the inner lower portion of the body 230 is divided into the three blocks, as shown in FIG. 6. In the preferred embodiments of the present invention, it is preferable to position the inlet tube 210 and the outlet tube 220 in the different blocks divided by the isolating plate 240.

Meanwhile, each side of the isolating plate 240 may be in contact to the inner surface of the body 230, or may be at a predetermined interval from the inner surface of the body 230. As shown in FIG. 4, if each side of the isolating plate 240 is in contact to the inner surface of the body 230, the liquid phase refrigerant falling through the inlet tube 210 may be stored in a space surrounded by the isolating plate 240 and the inner surface of the body 230. Accordingly, even though the liquid phase refrigerant flows into the inside of the body 230 in a small amount, the level of the liquid phase refrigerant becomes high in a short time period. That is, the liquid phase refrigerant falling through the inlet tube 210 is sprayed into the liquid phase refrigerant stored in the space surrounded by the isolating plate 240 and the inner surface of the body 230, so that it is possible to prevent the splash of the liquid phase refrigerant since the liquid phase refrigerant is not in direct contact to the inner bottom of the body 230. Thus, it is possible to prevent the liquid phase refrigerant from flowing into the outlet tube 220.

If each side of the isolating plate 2 is positioned at the predetermined interval from the inner surface of the body 230, the liquid phase refrigerant is not stored only in the space surrounded by the isolating plate 240 and the inner surface of the body 230. However, since the isolating plate 240 has a considerable height, the isolating plate 240 serves as a shielding wall for preventing the liquid phase refrigerant falling through the inlet tube 210 from being scattered upwardly. Thus, it is possible to prevent the liquid phase refrigerant from flowing into the outlet tube 220.

Figure 5:
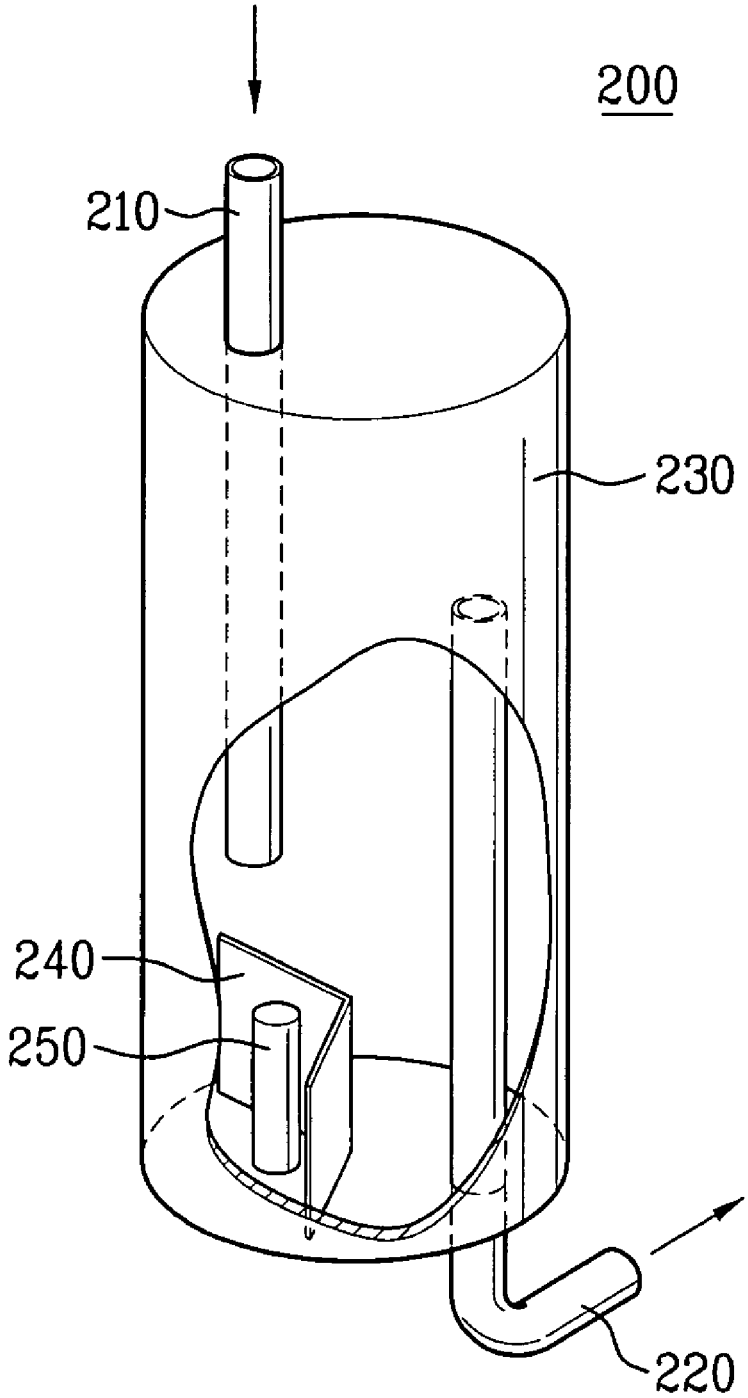
FIG. 5 is a partially cutaway perspective view illustrating an accumulator according to another preferred embodiment of the present invention.

FIG. 5 illustrates an accumulator according to another preferred embodiment of the present invention. Referring to FIG. 5, the accumulator further includes a heater 250 with the aforementioned components of FIG. 4. At this time, the heater, as shown in FIG. 5, may be provided on an inner bottom of a body 230, or an inner surface of the body 230. In FIG. 5, the heater is formed in a stick shape. However, it is possible to form the heater in various shapes. The heater 250 heats a refrigerant stored in the inside of the body 230 of the accumulator 200.

In case the inner lower portion of the body 230 is divided into two blocks by an isolating plate 240, as shown in FIG. 5, it is preferable to position the heater 250 and an inlet tube 210 in the same block. As shown in FIG. 6, if the inner lower portion of the body 230 is divided into the plurality of blocks by the isolating plate 240, each block may have the individual heater 250. If necessary, the heater 250 may be provided in the different block from the inlet tube 210, or the heater 250 may be provided in some of the blocks.

In case the heater 250 is provided in the accumulator 200, it is preferable to form the heater 250 having a height lower than that of the isolating plate 240. Preferably, each side of the isolating plate 240 is in contact to the inner surface of the body 230, for storing the liquid phase refrigerant in a space surrounded by the isolating plate 240 and the inner surface of the body 230. If the heater 250 and the isolating plate 240 have the aforementioned structures, the heater 250 is completely immersed in the liquid phase refrigerant stored in the space surrounded by the isolating plate 240 and the inner surface of the body 230, thereby preventing overheating and damages of the heater 250. Meanwhile, if the heater 250 has the overheating prevention function, the heater 250 may have the height higher than that of the isolating plate 240.

Hereinafter, on an operation mode of the aforementioned air conditioning system according to the present invention, the flow of the refrigerant and the operation of the accumulator 200 will be described as follows. The air conditioning system according to the present invention selectively operates a cooling operation mode for cooling the indoor room or a heating operation mode for heating the indoor room. For reference, a solid arrow indicates the refrigerant flow in the cooling operation mode of the air conditioning system, and a dotted arrow indicates the refrigerant flow in the heating operation mode of the air conditioning system according to the present invention.

Referring to FIG. 3, on the cooling operation mode of the air conditioning system according to the present invention, the flowing control valve 120 is controlled to connect the first port 121 to the second port 122, and to connect the third port 123 to the fourth port 124, simultaneously. Also, the operation number of the compressors 110 and the amount of flowing refrigerant are determined according to load capacity required for cooling the indoor room.

First, the refrigerant discharged from the compressor 110 flows into the first heat exchanger 130 provided outdoors by the guide of the flowing control valve 120. At this time, the check valve 111 prevents the discharged refrigerant from flowing into the compressor 110 that is not operated. As the refrigerant is condensed in the first heat exchanger 130, the refrigerant radiates condensing heat to the surroundings, whereby the heat radiated from the first heat exchanger 130 is discharged to the outdoor room. After the liquid phase refrigerant condensed in the first heat exchanger 130 passes through the first expansion device 151 and the second expansion device 155, sequentially, the liquid phase refrigerant is expanded. Then, the refrigerant absorbs the surrounding heat in the second heat exchanger 140 by vaporizing, so that the air becomes cool. That is, the cooled air heat-exchanged by the second heat exchanger 140 is discharged into the indoor room, thereby cooling the indoor room.

The gas phase refrigerant vaporized in the second heat exchanger 140 flows into the accumulator 200 by the guide of the flowing control valve 120. At this time, most of the refrigerant flowing into the accumulator 200 is in the gas phase, but some refrigerant is in the liquid phase. The liquid phase refrigerant flowing into the accumulator 200 is at a high atmospheric pressure of 7. Thus, when the liquid phase refrigerant is sprayed through the inlet tube 210, the outlet tube 220 may be splashed with the liquid phase refrigerant from the inner bottom of the body 230. However, the isolating plate 240 is provided in the accumulator of the air conditioning system according to the present invention, so that it is possible to prevent the outlet tube 220 from being splashed with the liquid phase refrigerant. That is, it is possible to prevent the liquid phase refrigerant from flowing into the outlet tube 220. Accordingly, in the accumulator of the air conditioning system according to the present invention, only gas phase refrigerant flows into the compressor 110, thereby preventing noise, lowering of compression efficiency, and operational problems by the inflow of the liquid phase refrigerant. Also, the air conditioning system according to the present invention prevents cooling efficiency from being lowered.

Next, on the heating operation mode of the air conditioning system according to the present invention, the flowing control valve 120 is controlled to connect the first port 121 to the fourth port 124, and to connect the second port 122 to the third port 123. Also, the operation number of the compressors 110 and the amount of flowing refrigerant are determined according to load capacity required for heating the indoor room.

The gas phase refrigerant discharged from the compressor 110 flows into the second heat exchanger 140 provided indoors by the guide of the flowing control valve 120. Then, when the refrigerant is condensed in the second heat exchanger 140, the refrigerant radiates heat to the surroundings, so that condensing heat is discharged to the indoor room, thereby heating the indoor room.

The liquid phase refrigerant condensed in the second heat exchanger 140 passes through the second expansion device 155, and then is expanded in the first expansion device 151. Also, the refrigerant is vaporized in the first heat exchanger 130 provided indoors, thereby absorbing surrounding heat. The refrigerant vaporized through the second heat exchanger 140 passes through the flowing control valve 120, and then flows into the accumulator 200. According to the aforementioned process, only gas phase refrigerant flows into the compressor 110 in the accumulator according to the present invention.

Generally, when heating the indoor room, the temperature of the outdoor room is low. Accordingly, in case the heat exchanging process of the low-temperature external air is continuously performed in the first heat exchanger 130, the first heat exchanger 130 has the frost on the surface thereof, thereby lowering heat-exchanging and heating efficiency.

For preventing the surface of the first heat exchanger 130 from being frosted over, the heater 250 heats the refrigerant temporarily stored in the accumulator 200. Thus, the temperature of the refrigerant flowing inside the air conditioning system goes up, and the temperature of the refrigerant vaporized in the first heat exchanger 130 becomes high, thereby preventing the surface of the first heat exchanger 130 from being frosted over. Accordingly, it is possible to prevent lowering of heat-exchange and heating efficiency. Meanwhile, the heater 250 provided in the accumulator 200 is higher than the isolating plate 240, so that the heater 250 is immersed in the liquid phase refrigerant, thereby preventing overheating and damages of the heater 250, which may be generated when the front end of the heater 250 is exposed.

As mentioned above, the accumulator and the air conditioning system using the same according to the present invention has the following advantages.

The accumulator according to the present invention prevents the liquid phase refrigerant from flowing into the compressor, so that it is possible to prevent the noise from generating when the liquid phase refrigerant flows into the compressor, and to prevent the compression efficiency from being lowered. Also, as the compression efficiency goes up, the cooling or heating efficiency is improved, thereby obtaining cut-down of energy consumption.

On the heating operation mode of the air conditioning system according to the present invention, the heater heats the refrigerant flowing inside the accumulator, thereby preventing the surface of the first heat exchanger from being frosted over. Accordingly, the heat-exchange and heating efficiency is improved in the air conditioning system according to the present invention. Also, the heater is completely immersed in the liquid phase refrigerant stored in the space surrounded by the isolating plate and the inner surface of the body, thereby preventing overheating and damages of the heater.

In the aforementioned preferred embodiment of the present invention, the air conditioning system for cooling or heating one room is disclosed. However, the improved accumulator according to the prevent invention may be applicable to a multi-air conditioning system for cooling or heating a plurality of rooms according to the same method in that it is possible to exchange the related art accumulator for the improved accumulator according to the present invention without a system structural change.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An accumulator comprising:

a body having a space therein;

an inlet tube extending downwardly into the body from a top of the body and including an end positioned at an inner lower portion of the body, such that a liquid phase refrigerant flows into the body;

an outlet tube extending upwardly into the body from a bottom of the body and including an end positioned at an inner upper portion of the body, such that the refrigerant is discharged from the body; and an isolating plate provided on an inner bottom of the body between the inlet tube and the outlet tube, and positioned such that the liquid phase refrigerant is prevented from flowing into the outlet tube.

2. The accumulator of claim 1, wherein each side of the isolating plate contacts an inner surface of the body.

3. The accumulator of claim 1, wherein each side of the isolating plate is spaced by a predetermined interval, from an inner surface of the body.

4. The accumulator of claim 1, further comprising:

at least one heater provided on the inner bottom of the body, for heating the refrigerant in the body.

5. The accumulator of claim 4, wherein the inner lower portion of the body is divided into a plurality of blocks, and the heater and the inlet tube are provided in the same block.

6. The accumulator of claim 1, wherein the isolating plate divides the inner lower portion of the body into two blocks.

7. The accumulator of claim 1, wherein the isolating plate divides the inner lower portion of the body into a plurality of blocks.

8. The accumulator of claim 7, further comprising:

a plurality of heaters provided on each block of the inner bottom of the body.

9. An air conditioning system comprising:

at least one compressor that compresses a gas phase refrigerant at a high pressure and that discharges the compressed refrigerant;

a flow control valve connected to the compressor, for controlling a flow direction of the refrigerant according to an operation mode;

a plurality of heat exchangers, respectively positioned indoor and outdoor and connected to the flow control valve;

at least one expansion device provided in a refrigerant tube that directly connects the heat exchangers; and an accumulator that temporarily stores the refrigerant passing through the heat exchangers, and that is connected to an inlet of the compressor such that the gas phase refrigerant is provided to the compressor, said accumulator comprising:

a body having a space therein;

an inlet tube connected to the flow control valve, said inlet tube extending downwardly into the body from a top of the body and including an end positioned at an inner lower portion of the body;

an outlet tube connected to the compressor, said outlet tube extending upwardly into the body from a bottom of the body and including an end positioned at an inner upper portion of the body; and an isolating plate provided on an inner bottom of the body between the inlet tube and the outlet tube, and positioned such that the liquid phase refrigerant is prevented from splashing and flowing into the outlet tube.

10. The air conditioning system of claim 9, further comprising:

a plurality of check valves, each provided between the outlet of one of the at least one compressors and the flow control valve, such that the refrigerant is prevented from flowing into the outlet of the compressor.

11. The air conditioning system of claim 9, wherein each of the compressors has a different capacity.

12. The air conditioning system of claim 9, wherein each side of the isolating plate contacts an inner surface of the body.

13. The air conditioning system of claim 9, wherein each side of the isolating plate is spaced by a predetermined interval, from an inner surface of the body.

14. The air conditioning system of claim 9, further comprising:

at least one heater provided on the inner bottom of the body, for heating the refrigerant stored in the body.

15. The air conditioning system of claim 14, wherein an inner lower portion of the body is divided into a plurality of blocks, and the heater and the inlet tube are provided in the same block.

16. The air conditioning system of claim 9, wherein the isolating plate divides the inner lower portion of the body into two blocks.

17. The air conditioning system of claim 9, wherein the isolating plate divides the inner lower portion of the body into a plurality of blocks.

18. The air conditioning system of claim 17, further comprising:

a plurality of heaters provided on each block of the inner bottom of the body.

19. An air conditioning system comprising:

a compressor that compresses and pumps refrigerant;

an indoor heat exchanger that communicates with the compressor and conducts a heat exchange between the refrigerant and indoor air;

an outdoor heat exchanger that communicates with the compressor and conducts a heat exchange between the refrigerant and outdoor air; and an accumulator that communicates with the compressor and heat exchangers, said accumulator comprising:

a body having a space therein;

an inlet tube extending into the body through a top of the body, said inlet tube introducing refrigerant into the space and including an end positioned at an inner lower portion of the body;

an outlet tube extending into the body through a bottom of the body, said outlet tube exhausting a gas phase refrigerant in the space and including an end positioned at an inner upper portion of the body; and an isolating plate provided on the bottom of the body between the inlet tube and the outlet tube, said isolating plate preventing a liquid phase refrigerant from flowing into the outlet tube.

20. The accumulator as claimed in claim 19, wherein the end of the outlet tube is positioned higher than the end of the inlet tube so as to prevent a liquid phase refrigerant introduced into the body through the inlet tube from flowing into the outlet tube directly.

21. The accumulator as claimed in claim 19, further comprising:

a heater provided on the bottom of the body between the isolating plate and an inner surface of the body, said heater heating a liquid phase refrigerant on the bottom of the body between the isolating plate and an inner surface of the body.

* * * * *